US012467191B2

(12) United States Patent
Jaynes et al.

(10) Patent No.: US 12,467,191 B2
(45) Date of Patent: Nov. 11, 2025

(54) DETERGENT POD DISPENSING DRAWER FOR A LAUNDRY TREATMENT APPLIANCE

(71) Applicant: Haier US Appliance Solutions, Inc., Wilmington, DE (US)

(72) Inventors: Christopher Jaynes, Louisville, KY (US); Karlarrious Dawain Donar, Jr., Louisville, KY (US); Christopher Gene Vowels, Cox's Creek, KY (US); V V Subrahmanyeswara Rao Kasa, Narsapur (IN); Troy Marshall Wright, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 292 days.

(21) Appl. No.: 17/875,018

(22) Filed: Jul. 27, 2022

(65) Prior Publication Data

US 2024/0035223 A1 Feb. 1, 2024

(51) Int. Cl.
*D06F 39/02* (2006.01)
*D06F 23/04* (2006.01)

(52) U.S. Cl.
CPC ..... *D06F 39/022* (2013.01); *D06F 23/04* (2013.01); *D06F 39/02* (2013.01); *D06F 39/028* (2013.01)

(58) Field of Classification Search
CPC ..... D06F 23/04; D06F 39/02; D06F 39/022; D06F 39/028
See application file for complete search history.

(56) References Cited

U.S. PATENT DOCUMENTS

| | | | | |
|---|---|---|---|---|
| 11,091,870 | B2 | 8/2021 | Mariuzzo et al. | |
| 11,359,325 | B2 * | 6/2022 | White | D06F 39/022 |
| 11,535,971 | B2 * | 12/2022 | Del Pos | D06F 39/028 |
| 2016/0237612 | A1 | 8/2016 | Ghosh et al. | |
| 2018/0355543 | A1 * | 12/2018 | Cinello | D06F 39/02 |
| 2020/0095720 | A1 * | 3/2020 | Bensel | D06F 39/028 |
| 2021/0131018 | A1 * | 5/2021 | Wright | D06F 39/088 |

(Continued)

FOREIGN PATENT DOCUMENTS

| | | | | |
|---|---|---|---|---|
| JP | 2016073330 A | 5/2016 | | |
| WO | WO-2022001931 A1 * | 1/2022 | | D06F 39/022 |

OTHER PUBLICATIONS

Machine translation of WO-2022001931-A1 to Jiang et al. (Year: 2022).*

*Primary Examiner* — Joseph L. Perrin
(74) *Attorney, Agent, or Firm* — Dority & Manning, P.A.

(57) ABSTRACT

A laundry treatment appliance includes a cabinet defining a drawer receiving space, a tub accommodated within the cabinet, the tub storing water, a basket rotatably mounted within the tub to rotate about a rotation axis, and a dispenser drawer slidably received within the drawer receiving space, the dispenser drawer being fluidly coupled to the tub. The dispenser drawer includes a base plate, a plurality of body walls extending from the base plate along the vertical direction to define a detergent chamber, and a plurality of inner partition portions protruding from the base plate along the vertical direction, wherein the plurality of inner partition portions defines a pod compartment within the detergent chamber, the pod compartment being in fluid communication with the detergent chamber through one or more portions of the plurality of inner partition portions.

20 Claims, 5 Drawing Sheets

(56) References Cited

U.S. PATENT DOCUMENTS

| | | | | |
|---|---|---|---|---|
| 2021/0230785 | A1* | 7/2021 | Wright | D06F 39/02 |
| 2021/0254253 | A1 | 8/2021 | Pollett et al. | |
| 2021/0254258 | A1* | 8/2021 | Damtew | D06F 39/02 |
| 2021/0254260 | A1* | 8/2021 | Damtew | D06F 39/028 |
| 2021/0254261 | A1* | 8/2021 | Damtew | D06F 39/028 |
| 2021/0254262 | A1* | 8/2021 | Damtew | D06F 39/028 |
| 2021/0317607 | A1* | 10/2021 | Damtew | D06F 39/026 |
| 2022/0282420 | A1* | 9/2022 | White | D06F 39/02 |

* cited by examiner

DETERGENT POD DISPENSING DRAWER FOR A LAUNDRY TREATMENT APPLIANCE

FIELD OF THE INVENTION

The present subject matter relates generally to automated washing appliances, such as washing machine appliances, and more particularly to an additive dispensing assembly for supplying a wash fluid to a washing appliance.

BACKGROUND OF THE INVENTION

Modern washing appliances, such as washing machine appliances and dishwasher appliances, often include an additive dispenser to dispense a wash fluid therefrom. Prior to use of a washing appliance, a wash additive, such as detergent, may be placed within the additive dispenser (e.g., by a user) to be selectively added to a wash chamber during a wash cycle of the appliance. For example, washing machine appliances generally include a tub for containing water or wash fluid (e.g., water and detergent, bleach, or other wash additives), as well as a basket that is rotatably mounted within the tub and defines a wash chamber for receipt of articles for washing. During normal operation of such washing machine appliances, the wash liquid is directed into the tub and onto articles within the wash chamber.

Increasingly, there is a desire by consumers to use discrete additive pods with washing appliances. The additive pods are often filled with a premeasured volume of one or more wash additives (e.g., detergents, fabric softeners, rinse aids, etc.). For instance, a granular wash additive and liquid wash additive may both be encased within a water-soluble casing to form a discrete additive pod. Since they are generally self-contained and eliminate the need for measuring exact amounts of wash additives, additive pods may make using a washing appliance easier. Moreover, use of an additive pod may ensure that the correct amount of wash additive is used for a given wash load.

In spite of these advantages, using additive pods can also present certain drawbacks. For example, in some systems, it may be difficult to ensure that the additive pod dissolves completely. This may be especially true during a cold-water wash cycle. Oftentimes, users are forced to deposit additive pods directly into the wash basket. If the additive pod does not dissolve completely, remnants of the additive pod (e.g., the casing) may accumulate within, for example, the basket. This risks damaging or staining articles within the appliance. Moreover, an undissolved pod is generally wasteful since it can result in some volume of the wash additive not being used for an intended wash cycle. These drawbacks can be magnified if a user tries to use more than one pod or type of pod within the appliance.

As a result, there is a need for improved additive dispensers. In particular, it would be advantageous to provide an additive dispenser that could accommodate multiple different number or types of additive pods. Additionally or alternatively, it would be advantageous to provide an additive dispenser that can ensure improved dissolution of an additive pod during a washing operation.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a laundry treatment appliance is provided. The laundry treatment appliance may include a cabinet defining a drawer receiving space, a tub accommodated within the cabinet, the tub storing water, a basket rotatably mounted within the tub to rotate about a rotation axis, and a dispenser drawer slidably received within the drawer receiving space, the dispenser drawer being fluidly coupled to the tub. The dispenser drawer may include a base plate, a plurality of body walls extending from the base plate along the vertical direction to define a detergent chamber, and a plurality of inner partition portions protruding from the base plate along the vertical direction, wherein the plurality of inner partition portions defines a pod compartment within the detergent chamber, the pod compartment being in fluid communication with the detergent chamber through one or more portions of the plurality of inner partition portions.

In another exemplary aspect of the present disclosure, a dispenser drawer is provided. The dispenser drawer may include a base plate, a plurality of body walls extending from the base plate along the vertical direction to define a detergent chamber, and a plurality of inner partition portions protruding from the base plate along the vertical direction, wherein the plurality of inner partition portions defines a pod compartment within the detergent chamber, the pod compartment being in fluid communication with the detergent chamber through one or more portions of the plurality of inner partition portions.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
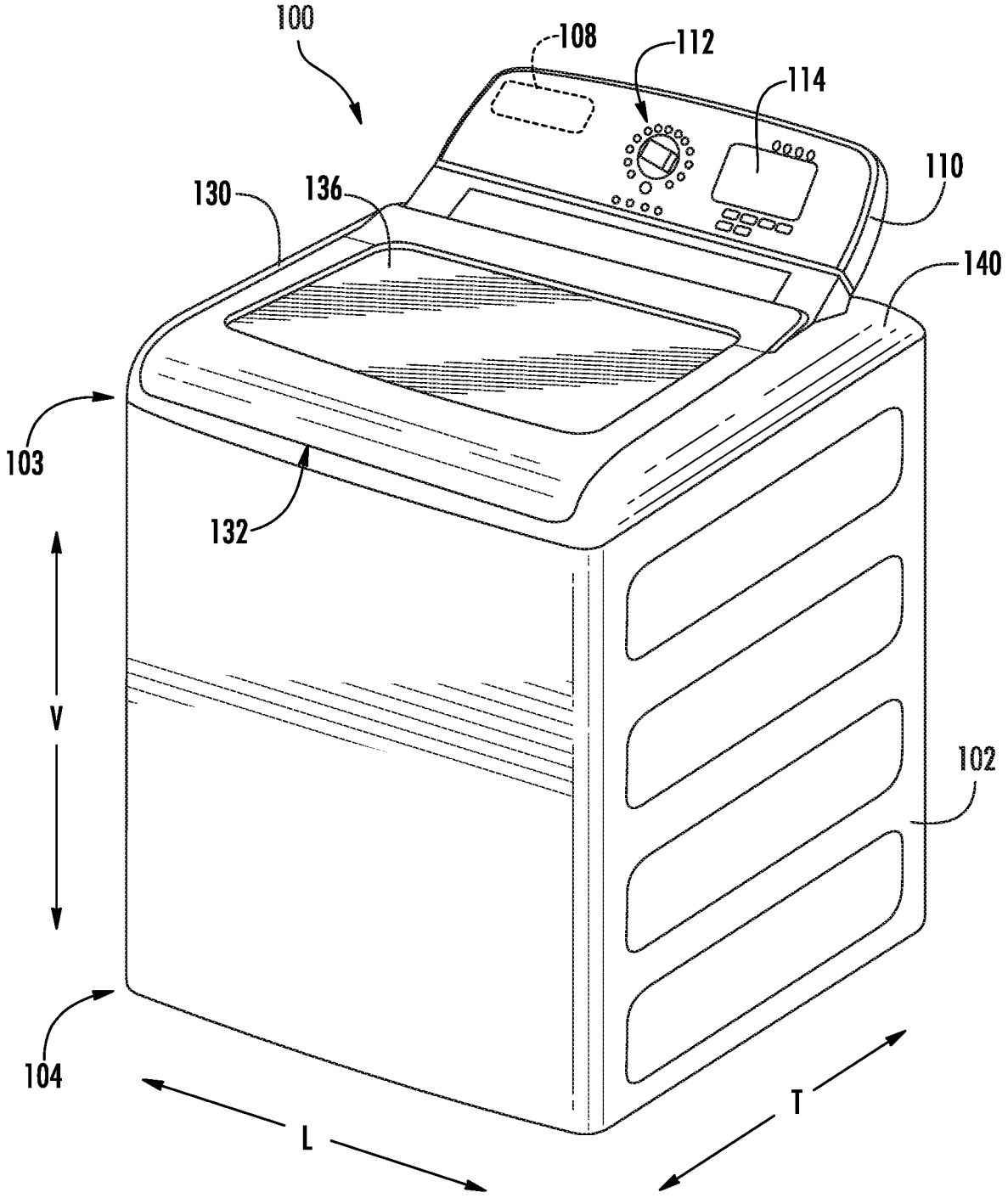
FIG. 1 provides a perspective view of a washing machine appliance according to exemplary embodiments of the present disclosure with a door of the washing machine appliance shown in a closed position.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
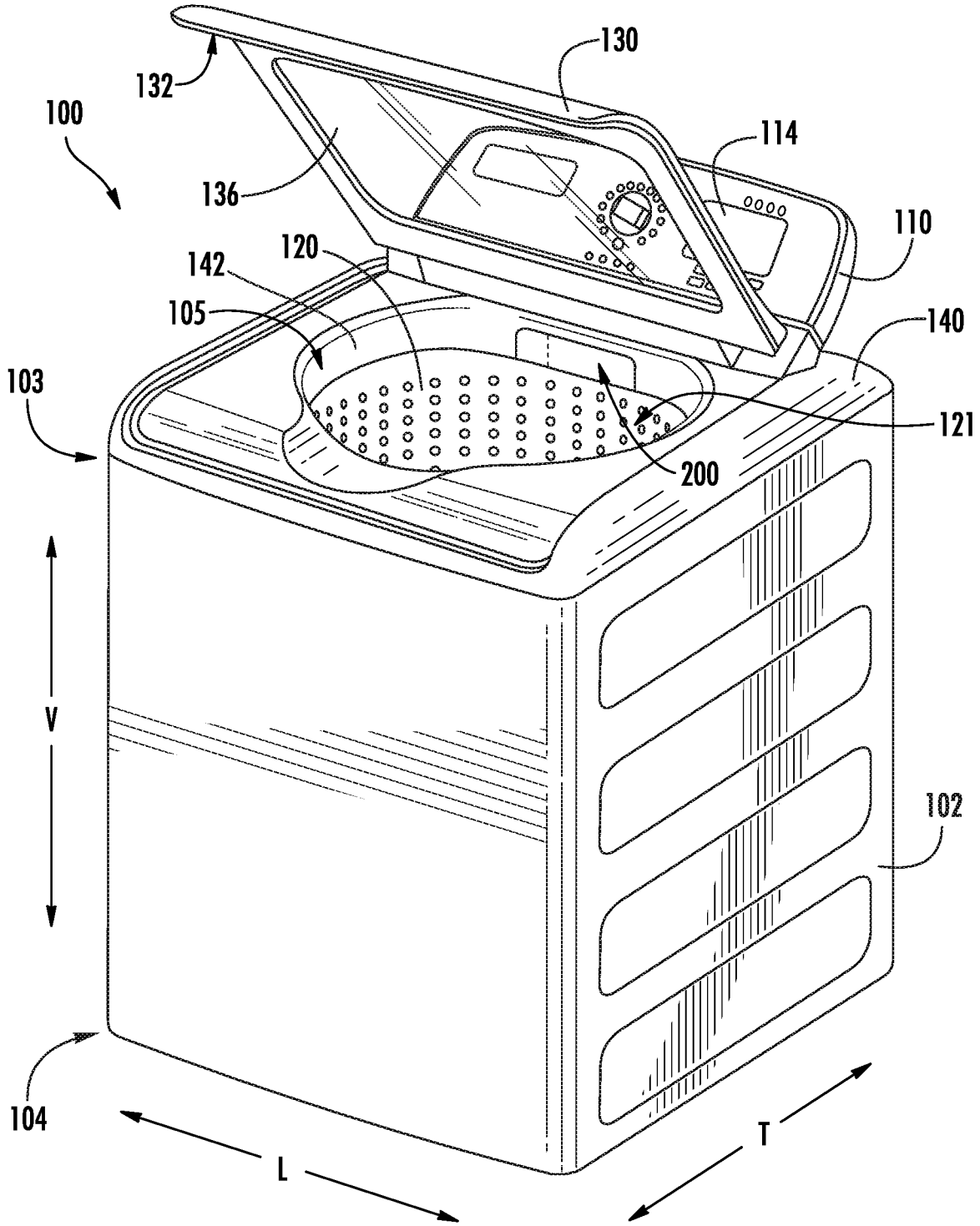
FIG. 2 provides a perspective view of the exemplary washing machine appliance of FIG. 1 with the door shown in an open position.
Figure 3:
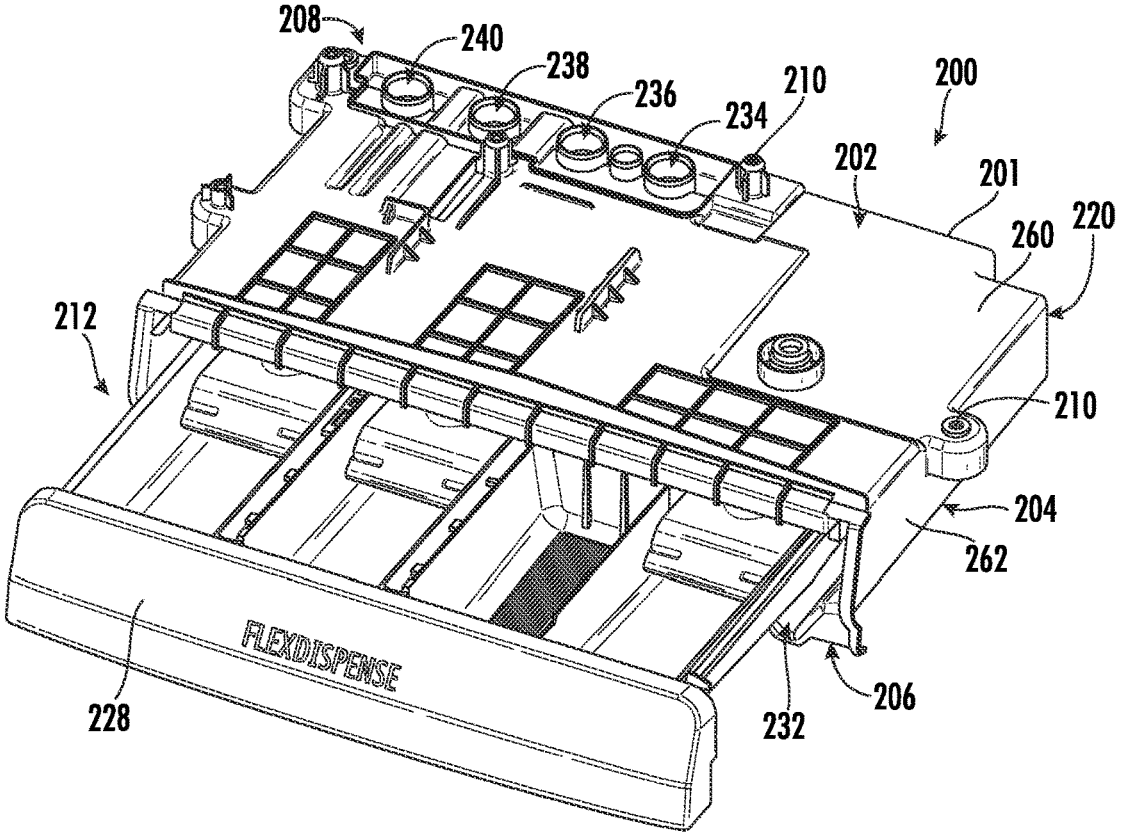
FIG. 3 provides a front, perspective view of an additive dispenser in a withdrawn position according to exemplary embodiments of the present disclosure.
Figure 4:
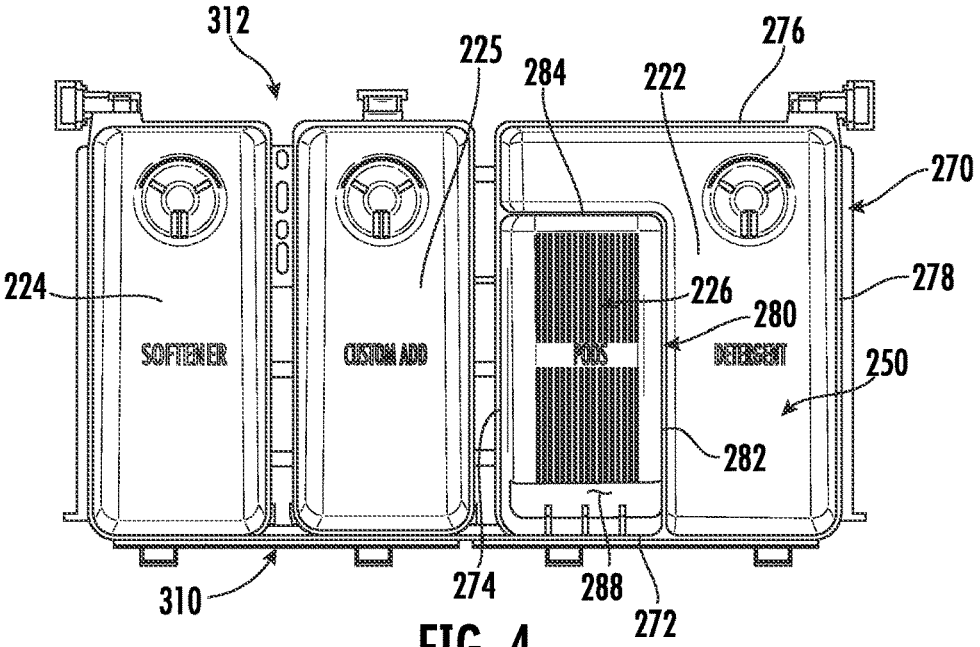
FIG. 4 provides a top view of an insert of the exemplary additive dispenser of FIG. 3, including multiple chambers.
Figure 5:
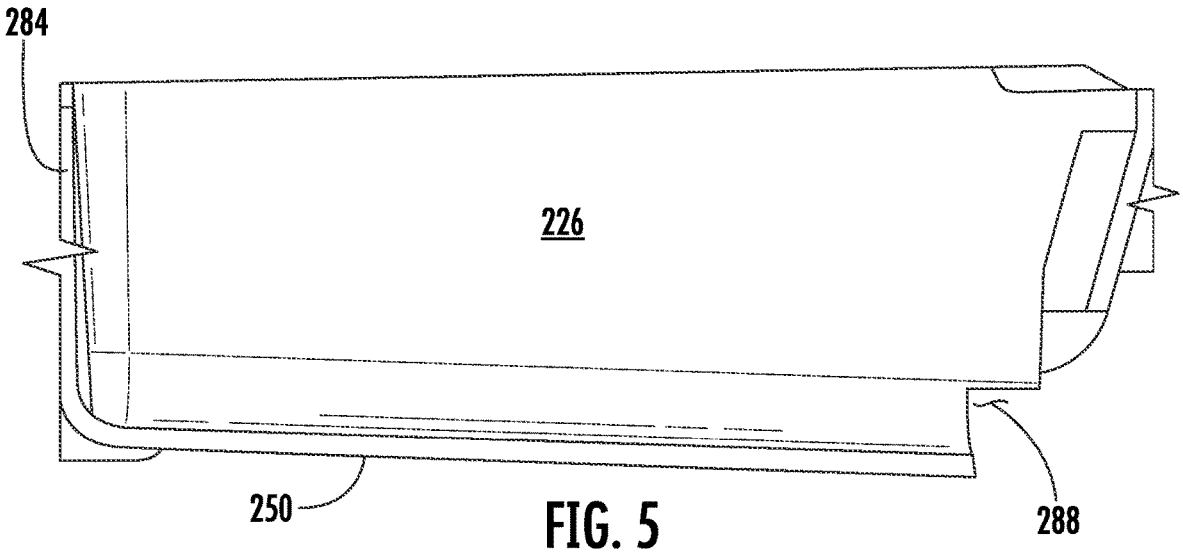
FIG. 5 provides a side view of the exemplary insert of FIG. 4.
Figure 6:
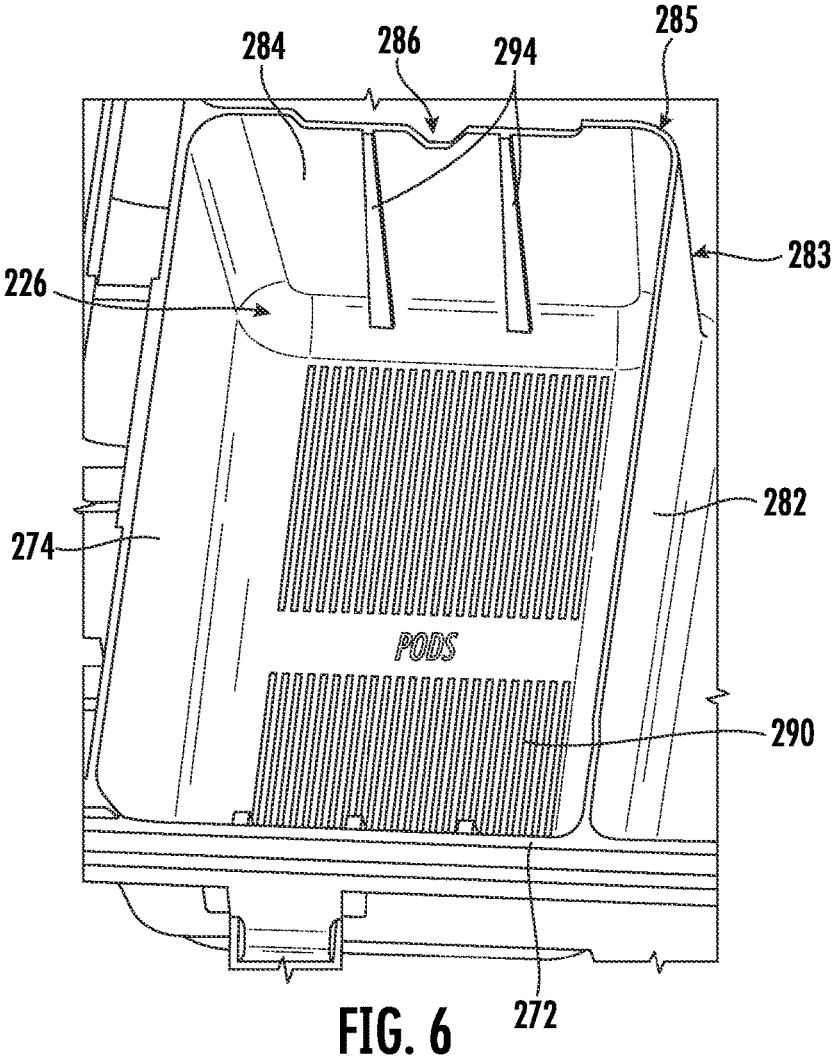
FIG. 6 provides a perspective view of an exemplary chamber of the insert of FIG. 4.
Figure 7:
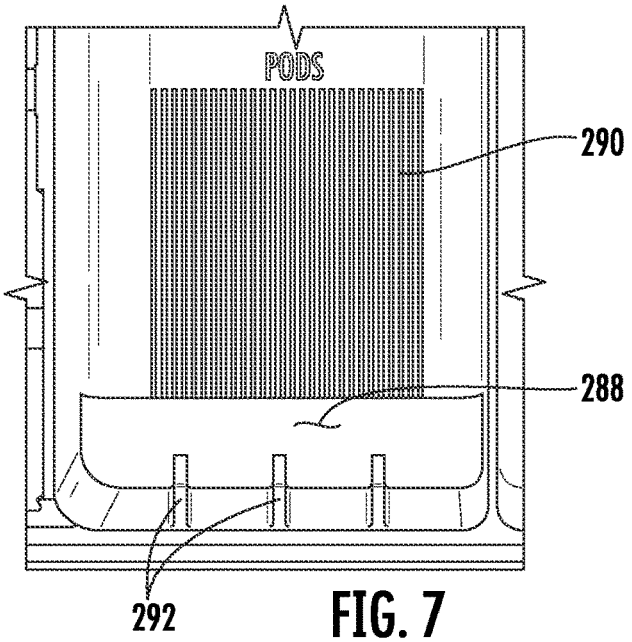
FIG. 7 provides a close-up top view of the exemplary chamber of FIG. 6.

Turning now to the figures, FIGS. 1 and 2 illustrate an exemplary embodiment of a washing appliance. Specifically, the washing appliance is illustrated as a vertical axis washing machine appliance 100. In FIG. 1, a lid or door 130 is shown in a closed position. In FIG. 2, door 130 is shown in an open position. Washing machine appliance 100 generally defines a vertical direction V, a lateral direction L, and a transverse direction T, each of which is mutually perpendicular, such that an orthogonal coordinate system is defined.

While described in the context of a specific embodiment of vertical axis washing machine appliance 100, using the teachings disclosed herein it will be understood that vertical axis washing machine appliance 100 is provided by way of example only. Other washing appliances having different configurations, different appearances, or different features may also be utilized with the present subject matter as well (e.g., horizontal axis washing machines).

Washing machine appliance 100 has a cabinet 102 that extends between a top portion 103 and a bottom portion 104 along the vertical direction V. A wash basket 120 is rotatably mounted within cabinet 102. A motor (not shown) may be in mechanical communication with wash basket 120 to selectively rotate wash basket 120 (e.g., about a rotation axis during an agitation or a rinse cycle of washing machine appliance 100). Wash basket 120 is received within a wash tub 121 and is configured for receipt of articles for washing. The wash tub 121 holds wash and rinse fluids for agitation in wash basket 120 within wash tub 121. In optional embodiments, an agitator or impeller (not shown) extends into wash basket 120 and is also in mechanical communication with the motor. The impeller may assist agitation of articles disposed within wash basket 120 during operation of washing machine appliance 100.

In some embodiments, cabinet 102 of washing machine appliance 100 has a top panel 140. Top panel 140 defines an opening 105 that permits user access to wash basket 120 of wash tub 121. Door 130, which may be rotatably mounted to top panel 140, permits selective access to opening 105. In particular, door 130 selectively rotates between the closed position shown in FIG. 1 and the open position shown in FIG. 2. In the closed position, door 130 inhibits access to wash basket 120. Conversely, in the open position, a user can access wash basket 120. In optional embodiments, a window 136 in door 130 permits viewing of wash basket 120 when door 130 is in the closed position (e.g., during operation of washing machine appliance 100). Door 130 also includes a handle 132 that, for example, a user may pull or lift when opening and closing door 130. Further, although door 130 is illustrated as mounted to top panel 140, alternatively, door 130 may be mounted to another portion of cabinet 102 or any other suitable support.

In certain embodiments, a control panel 110 with at least one input selector 112 extends from top panel 140. Control panel 110 and input selector 112 collectively form a user interface input for operator selection of machine cycles and features. A display 114 of control panel 110 indicates selected features, operation mode, a countdown timer, or other items of interest to appliance users regarding operation. Operation of washing machine appliance 100 may be controlled by a controller or processing device 108 connected (e.g., electrically coupled) to control panel 110 for user manipulation to select washing machine cycles and features. In response to user manipulation of control panel 110, controller 108 operates the various components of washing machine appliance 100 to execute selected machine cycles and features.

Controller 108 may include a memory (e.g., non-transitive media) and microprocessor, such as a general or special purpose microprocessor operable to execute programming instructions or micro-control code associated with a selected machine cycles and features. The memory may represent random access memory such as DRAM, or read only memory such as ROM or FLASH. In certain embodiments, the processor executes programming instructions stored in memory. The memory may be a separate component from the processor or may be included onboard within the processor. Alternatively, controller 108 may be constructed without using a microprocessor (e.g., using a combination of discrete analog or digital logic circuitry, such as switches, amplifiers, integrators, comparators, flip-flops, AND gates, and the like) to perform control functionality instead of relying upon software. Control panel 110 and other components of washing machine appliance 100 (e.g., one or more sensors, such as a pressure sensor mounted to tub 121) may be in communication with controller 108 via one or more signal lines or shared communication busses.

In some embodiments, during operation of washing machine appliance 100, laundry items are loaded into wash basket 120 through opening 105, and a washing operation is initiated through operator manipulation of input selectors 112. Wash basket 120 or wash tub 121 is filled with water and detergent or other fluid additives via an additive dispenser 200, which will be described in detail below. One or more valves can be controlled by washing machine appliance 100 to provide for filling wash basket 120 to the appropriate level for the volume or number of articles being washed or rinsed. By way of example for a wash cycle, once wash tub 121 is properly filled with fluid, the contents of wash tub 121 can be agitated (e.g., with an impeller as discussed previously) for washing of laundry items in wash basket 120.

After the agitation phase of the wash cycle is completed, wash tub 121 can be drained. Laundry articles can then be rinsed (e.g., for a rinse cycle) by again adding fluid to wash basket 120 depending on the specifics of the washing operation selected by a user. The impeller may again provide agitation within wash basket 120. One or more spin cycles also may be used. In particular, a spin cycle may be applied after the wash cycle or after the rinse cycle to wring wash fluid from the articles being washed. During a spin cycle, wash basket 120 is rotated at relatively high speeds. After articles disposed in wash basket 120 are cleaned or washed, the user can remove the articles from wash basket 120 (e.g., by reaching into wash basket 120 through opening 105).

Referring now generally to FIGS. 2 through 6, additive dispenser 200 will be described in more detail. Although the discussion below refers to additive dispenser 200, one skilled in the art will appreciate that the features and configurations described may be used for other additive dispensers in other washing appliances as well. For example, additive dispenser 200 may be positioned on a front of cabinet 102, may have a different shape or chamber configuration, and may dispense water, detergent, or other additives. Other variations and modifications of the exemplary embodiment described below are possible, and such variations are contemplated as within the scope of the present subject matter.

In exemplary embodiments, additive dispenser 200 has a housing 201 that generally forms a box (e.g., having a substantially rectangular cross-section) defining a top 202 and a bottom 204 spaced apart along the vertical direction V. Additive dispenser 200 also defines a front end 206 and a rear end 208 spaced apart along the transverse direction T. In some such embodiments, front end 206 is open (e.g., to permit a dispenser drawer 212 or wash fluid therethrough) while rear end 208 is closed (e.g., thereby restricting the passage of wash fluid from housing 201 at rear end 208). In certain embodiments, additive dispenser 200 includes an upper top plate 260 fixed to a lower base plate 262, which together selectively enclose or receive a dispenser drawer 212.

In some embodiments, additive dispenser 200 is mounted underneath top panel 140 of cabinet 102 such that front side 206 is visible inside opening 105. More specifically, additive dispenser 200 may be mounted to top panel 140 using a plurality of mounting features 210, which may, for example, be configured to receive mechanical fasteners. One skilled in the art will appreciate that additive dispenser 200 may be mounted in other locations and use other mounting means according to alternative exemplary embodiments.

As shown, additive dispenser 200 may include or define a mixing chamber 220 configured to receive one or more additive compartments. For example, according to the illustrated embodiments, mixing chamber 220 is defined by top plate 260 and base plate 262. Together, top plate 260 and base plate 262 are configured to slidably receive a dispenser drawer 212 defining multiple additive compartments (e.g., 222, 224, 225).

As will be described in greater detail below, dispenser drawer 212 generally extends (e.g., along the transverse direction T) from a forward end 310 to a rearward end 312. When assembled, forward end 310 is generally positioned proximal to the rotation axis of basket 120 while rearward end 312 is positioned distal to the rotation axis of basket 120. Dispenser drawer 212 may define a primary (e.g., detergent) compartment 222, a secondary (e.g., softener or rinse) compartment 224, or a custom add compartment 225. In some embodiments, compartments 222, 224, 225 are slidably connected to the mixing chamber 220 (e.g., as part of a dispenser drawer 212 having laterally-positioned or vertically-positioned slides) and are connected to a front panel 228 of additive dispenser 200. In certain embodiments, the dispenser drawer 212 is fixed to front panel 228 (e.g., to slide therewith along the transverse direction T). In this manner, a user may pull on front panel 228 to slide compartments 222, 224, 225 or dispenser drawer 212 along the transverse direction T from a closed position to an open position (e.g., FIG. 3). Once extended, primary compartment 222, secondary compartment 224, or tertiary compartment 225 may be conveniently filled with a wash additive (e.g., liquid detergent, powder detergent, bleach, fabric softener, scent pellets, additive pods, rinse aid, etc.).

From the open position, front panel 228 may then be pushed back into mixing chamber 220 (i.e., to the closed position) before a wash cycle begins. Along with permitting water into the compartments 222, 224, 225 the closed position of additive dispenser 200 may restrict or inhibit user access to the compartments 222, 224, 225.

Generally, housing 201 may define an exhaust opening 232 downstream from mixing chamber 220 or dispenser drawer 212 to direct wash fluid, such as water or a mixture of water and at least one wash additive (e.g., detergent, fabric softener, bleach, dissolved scent pellets, dissolved additive pod, etc.) into wash tub 121 from additive dispenser 200. In some embodiments, exhaust opening 232 is defined through the bottom of mixing chamber 220 (e.g., on or through a bottom surface of base plate 262) to dispense the wash fluid into wash tub 121. Optionally, exhaust opening 232 may be defined at an open front end 206. Additionally or alternatively, exhaust opening 232 may extend rearward from front end 206. When assembled such that dispenser drawer 212 is fully received within additive dispenser 200, at least a portion of dispenser drawer 212 may be positioned above and axially aligned with exhaust opening 232.

Figure 8:
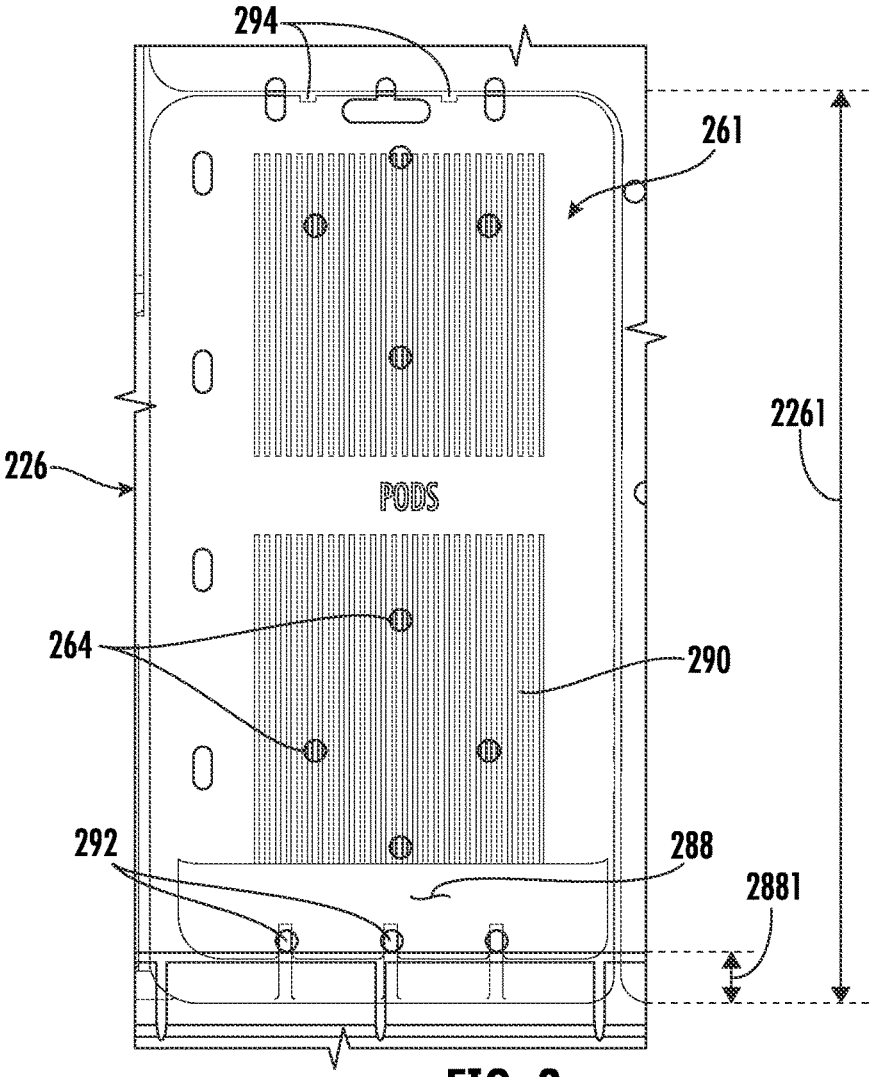
FIG. 8 provides a top view of the exemplary chamber of FIG. 6 including a shower plate.

Additive dispenser 200 may further include one or more valves configured to supply hot or cold water to mixing chamber 220. For example, according to the illustrated embodiment, a plurality of apertures may be defined on top 202 of mixing chamber 220 (e.g., on shower plate 261 in FIG. 8) for receiving water. Each receiving aperture may be in fluid communication with a different portion of the mixing chamber 220. A plurality of valve seats may be positioned over the top of each of those apertures to receive a valve that controls the flow of water through each receiving aperture.

Turning especially to FIGS. 4 through 8, portions (e.g., an insert) of dispenser drawer 212 are illustrated. In particular, compartments 222, 224, and 225 are illustrated. Dispenser drawer 212 may include a base plate 250. For instance, base plate 250 may define a bottom of dispenser drawer 212. Dispenser drawer 212 may include a plurality of body walls 270 extending from base plate 250 along the vertical direction V. With specific reference to main compartment (e.g., detergent chamber) 222, the plurality of body walls 270 may include a first body wall 272, a second body wall 274, a third body wall 276, and a fourth body wall 278. Each of the first, second, third, and fourth body walls 272, 274, 276, 278 may be positioned in a generally quadrilateral shape (e.g., a square or rectangle) to form detergent chamber 222.

Dispenser drawer 212 may include a plurality of inner partition portions 280. The plurality of inner partition portions 280 may protrude from base plate 250 along the vertical direction V. The plurality of inner partition portions 280 may be located within detergent chamber 222 (e.g., within the bounds formed by first, second, third, and fourth body walls 272, 274, 276, 278). The plurality of inner partition portions 280 may include a first inner partition portion 282 and a second inner partition portion 284. In detail, first inner partition portion 282 may extend from first body wall 272 along the transverse direction T. Thus, first inner partition portion 282 may include a distal end 283 located within detergent chamber 222. First inner partition portion 282 may be parallel to second body wall 284 and fourth body wall 278. Additionally or alternatively, first inner partition portion 282 may protrude (e.g., along the vertical direction V) to a vertical height that is approximately equal to a vertical height of the plurality of body walls 270.

The plurality of inner partition portions 280 may include the second inner partition portion 284. Second inner partition portion 284 may extend from second body wall 274 along the transverse direction T. Accordingly, second inner partition portion 284 may be perpendicular to first inner partition portion 282. Second inner partition portion 284 may include a distal end 285 located within detergent chamber 222. Distal end 285 of second inner partition portion 284 may connect with distal end 283 of first inner partition portion 282 (e.g., within detergent chamber 222). Second inner partition portion 284 may be parallel to first body wall 272 and third body wall 276.

First and second inner partition portions 282, 284 may collectively form an additional compartment (e.g., a pod compartment 226). Pod compartment 226 may be formed within detergent chamber 222 (e.g., as seen particularly in FIG. 4). Pod compartment 226 may be configured to selectively receive one or more detergent pods containing laundry detergent for washing operations. Accordingly, dispenser drawer 212 may include a liquid or powder detergent chamber 222 in addition to pod compartment 226.

Pod compartment 226 may be in fluid communication with detergent chamber 222 to allow water (e.g., via one or more of valve seats 234, 236, 238, 240) to flow from detergent chamber 222 to pod compartment 226. In detail, water (e.g., washing water) may be supplied to detergent chamber 222 (e.g., outside of pod compartment 226). The washing water may then flow from detergent chamber 222 into pod compartment 226. The washing water may then contact the detergent pod(s) provided within pod compartment 226 to initiate a dissolving action (e.g., of a coating or wrapping of the detergent). Advantageously, a dissolving action or process may be initiated immediately upon supplying water to the dispenser drawer.

To allow the fluid communication between detergent chamber 222 and pod compartment 226, a vertical height of at least a portion of second inner partition portion 284 may be less than the vertical height of first inner partition portion 282. For instance, as particularly shown in FIG. 6, second inner partition portion 284 may have a notch or groove 286 formed into a top edge thereof. In detail, the vertical height of second inner partition portion 284 at notch 286 may be less than the vertical height of first inner partition portion 282 and indeed the remaining parts of second inner partition portion 284. Accordingly, when shower plate 261 is placed into position over dispenser drawer 212, a gap may be formed between the top edge of second inner partition portion 284 and an underside of shower plate 261. The washing water within detergent chamber 222 may thus selectively flow into pod compartment 226 via notch 286.

Dispenser drawer 212 may include an outlet aperture 288 formed in base plate 250. In detail, outlet aperture 288 may be formed within pod compartment 226 (e.g., within the bounds formed by first and second inner partition portions 282, 284). Outlet aperture 288 may allow fluid communication between pod compartment 226 and wash tub 121 (or basket 120). For instance, outlet aperture 288 may be formed by removing at least a portion of base plate 250 within pod compartment 226. Outlet aperture 288 may be located at or near a front of pod compartment 226 (e.g., along the transverse direction T proximate the rotation axis of basket 120. Thus, outlet aperture 288 may be formed immediately adjacent to first body wall 272. A width 2881 of outlet aperture 288 (e.g., along the transverse direction T) may be large enough to allow detergent pods (and detergent pod materials) to fall through, into wash tub 121 below. For instance, the width 2881 of outlet aperture 288 may be between about 5% and about 15% of a total length 2261 of pod compartment 226. Additionally or alternatively, a length (e.g., along the lateral direction L) of outlet aperture 288 may be approximately equal to a width (along the lateral direction L). Advantageously, detergent pods supplied to pod compartment 226 may easily flow into basket 120 via outlet aperture 288

Base plate 250 may be sloped downward (e.g., along the vertical direction V) from second inner partition portion 284 toward outlet aperture 288. In detail, at least a portion of base plate 250 within pod compartment 226 may be angled with respect to the transverse direction T. As seen particularly in FIG. 5, a rear of base plate 250 may be positioned higher (e.g., along the vertical direction V) than a front (e.g., proximate outlet aperture 288) of base plate 250. Thus, a flow of washing water (and detergent from detergent pods placed in pod compartment 288) may naturally flow toward outlet aperture 288 due to gravity. According to some embodiments, an angle of base plate 250 with respect to the transverse direction T is between about 2° and about 10°.

Dispenser drawer 212 may include a plurality of ridges 290 formed within pod compartment 226. In detail, the plurality of ridges 290 may protrude upward from base plate 250 (e.g., along the vertical direction V) within pod compartment 226. A protrusion distance of each of the plurality of ridges 290 may vary according to embodiments. For instance, each of the plurality of ridges 290 may protrude between about 2 mm and about 5 mm from base plate 250. Additionally or alternatively, each of the plurality of ridges 290 may have different protrusion distances. The plurality of ridges 290 may be spaced apart from each other along the lateral direction L. Moreover, the plurality of ridges 290 may extend generally along the transverse direction T (e.g., along base plate 250 from a rear of pod compartment 226 toward outlet aperture 288). For example, the plurality of ridges 290 terminate at outlet aperture 288. Advantageously, wash water and detergent may be restricted from sticking to base plate 250, thus easily flowing into outlet aperture 288.

Dispenser drawer 212 may include a plurality of spines 292 formed within pod compartment 226. In detail, the plurality of spines 292 may protrude inward (e.g., along the transverse direction T into pod compartment 226) from first body wall 272. A protrusion distance of each of the plurality of spines 292 may vary according to embodiments. For instance, each of the plurality of spines 292 may protrude between about 5 mm and about 20 mm from first body wall 272. Additionally or alternatively, each of the plurality of spines 292 may have different protrusion distances. The plurality of spines 292 may be spaced apart from each other along the lateral direction L. Moreover, the plurality of spines 292 may extend generally along the vertical direction V (e.g., along first body wall 272 from a top of pod compartment 226 toward outlet aperture 288). For example, the plurality of spines 292 terminate at outlet aperture 288. Advantageously, wash water and detergent may be restricted from sticking to first body wall 272, thus easily flowing into outlet aperture 288.

Dispenser drawer 212 may include a plurality of ribs 294 formed within pod compartment 226. In detail, the plurality of ribs 294 may protrude inward (e.g., along the transverse direction T into pod compartment 226) from second inner partition portion 284. A protrusion distance of each of the plurality of ribs 294 may vary according to embodiments. For instance, each of the plurality of ribs 294 may protrude between about 5 mm and about 20 mm from first body wall 272. Additionally or alternatively, each of the plurality of ribs 294 may have different protrusion distances. Moreover, a protrusion distance may vary across a vertical length of each rib 294. For example, a protrusion distance of a rib 294 at a top of pod compartment 226 may be less than a protrusion distance of the rib 294 at base plate 250. The plurality of ribs 294 may be spaced apart from each other along the lateral direction L. Moreover, the plurality of ribs 294 may extend generally along the vertical direction V (e.g., along second inner partition portion 284 from the top of pod compartment 226 toward base plate 250). For example, the plurality of ribs 294 terminate at base plate 250. Advantageously, wash water and detergent may be restricted from sticking to second inner partition portion 284.

As described above, a shower plate 261 may be mounted within mixing chamber 220 (e.g., fixedly mounted above compartments 222, 226) to distribute water therethrough. When assembled such that dispenser drawer 212 is fully received within additive dispenser 200, shower plate 261 may be positioned directly above dispenser drawer 212. Moreover, shower plate 261 may be directly beneath the valve seats 234, 236, 238, 240 and their corresponding openings through top plate 260. Accordingly, wash water may be supplied to mixing chamber (e.g., pod compartment 226) via a plurality of apertures 264 formed in shower plate 261 and defined along the vertical direction V (e.g., extending vertically through shower plate 261).

According to some embodiments, at least some of the plurality of apertures 264 are positioned directly over the plurality of ribs 294 (e.g., along the vertical direction V). Additionally or alternatively, at least some of the plurality of apertures 264 may be positioned directly over the plurality of spines 292. In some instances, one aperture of the plurality of apertures 264 is directly (e.g., along the vertical direction V) aligned with an individual spine of the plurality of spines 292 (or an individual rib of the plurality of ribs 294). Thus, wash water may be supplied to each of the plurality of spines 292 and the plurality of ribs 294 to flush detergent and pod materials through outlet aperture 288.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A laundry treatment appliance defining a vertical direction, a lateral direction, and a transverse direction, the laundry treatment appliance comprising:

a cabinet defining a drawer receiving space;

a tub accommodated within the cabinet, the tub storing water;

a basket rotatably mounted within the tub to rotate about a rotation axis; and a dispenser drawer slidably received within the drawer receiving space, the dispenser drawer being fluidly coupled to the tub, the dispenser drawer comprising a base plate;

a plurality of body walls extending from the base plate along the vertical direction to define a detergent chamber; and a plurality of inner partition portions that are a plurality of solid walls protruding from the base plate along the vertical direction, wherein the plurality of inner partition portions defines a pod compartment that is physically separated from the surrounding detergent chamber by the plurality of solid walls, forming an enclosed space within the detergent chamber, the pod compartment being permanently affixed to the base plate and located within the detergent chamber, the pod compartment being in fluid communication with the detergent chamber through one or more portions of the plurality of inner partition portions.

2. The laundry treatment appliance of claim 1, wherein the plurality of inner partition portions comprises:

a first inner partition portion extending from a first body wall of the plurality of body walls along the transverse direction; and a second inner partition portion extending from a second body wall of the plurality of body walls along the lateral direction, wherein a distal end of the first inner partition portion connects with a distal end of the second inner partition portion.

3. The laundry treatment appliance of claim 2, wherein a height along the vertical direction of at least part of the second inner partition portion is less than a height of the first inner partition portion along the vertical direction.

4. The laundry treatment appliance of claim 2, wherein the dispenser drawer further comprises:

an outlet aperture formed in the base plate within the pod compartment proximate the first body wall, the outlet aperture allowing fluid communication between the pod compartment and the basket.

5. The laundry treatment appliance of claim 4, wherein the base plate is sloped downward along the vertical direction from the second inner partition portion toward the outlet aperture.

6. The laundry treatment appliance of claim 2, wherein the pod compartment further comprises:

a plurality of ridges protruding upward from the base plate along the vertical direction within the pod compartment, the plurality of ridges being spaced apart along the lateral direction and extending along the transverse direction from the second inner partition portion to the first body wall.

7. The laundry treatment appliance of claim 2, wherein the pod compartment further comprises:

a plurality of spines protruding from the first body wall along the transverse direction into the pod compartment, the plurality of spines being spaced apart along the lateral direction and extending along the vertical direction.

8. The laundry treatment appliance of claim 2, wherein the pod compartment further comprises:

a plurality of ribs protruding from the second inner partition portion along the transverse direction into the pod compartment, the plurality of ribs being spaced apart along the lateral direction and extending along the vertical direction from the base plate to a top of the pod compartment.

9. The laundry treatment appliance of claim 8, wherein the pod compartment further comprises:

a shower plate provided over the pod compartment along the vertical direction, the shower plate comprising a plurality of apertures defined along the vertical direction to allow a flow of water therethrough into the pod compartment.

10. The laundry treatment appliance of claim 9, wherein at least some of the plurality of apertures are formed vertically adjacent to the plurality of ribs.

11. A dispenser drawer for a laundry treatment appliance, the dispenser drawer defining a vertical direction, a lateral direction, and a transverse direction, the dispenser drawer comprising:

a base plate;

a plurality of body walls extending from the base plate along the vertical direction to define a detergent chamber; and a plurality of inner partition portions that are a plurality of solid walls protruding from the base plate along the vertical direction, wherein the plurality of inner partition portions defines a pod compartment that is physically separated from the surrounding detergent chamber by the plurality of solid walls, forming an enclosed space within the detergent chamber, the pod compartment being permanently affixed to the base plate and located within the detergent chamber, the pod compartment being in fluid communication with the detergent chamber through one or more portions of the plurality of inner partition portions.

12. The dispenser drawer of claim 11, wherein the plurality of inner partition portions comprises:

a first inner partition portion extending from a first body wall of the plurality of body walls along the transverse direction; and a second inner partition portion extending from a second body wall of the plurality of body walls along the lateral direction, wherein a distal end of the first inner partition portion connects with a distal end of the second inner partition portion.

13. The dispenser drawer of claim 12, wherein a height along the vertical direction of at least part of the second inner partition portion is less than a height of the first inner partition portion along the vertical direction.

14. The dispenser drawer of claim 12, further comprising:

an outlet aperture formed in the base plate within the pod compartment proximate the first body wall, the outlet aperture allowing fluid communication between the pod compartment and the laundry treatment appliance.

15. The dispenser drawer of claim 14, wherein the base plate is sloped downward along the vertical direction from the second inner partition portion toward the outlet aperture.

16. The dispenser drawer of claim 12, the pod compartment further comprising:

a plurality of ridges protruding upward from the base plate along the vertical direction within the pod compartment, the plurality of ridges being spaced apart along the lateral direction and extending along the transverse direction from the second inner partition portion toward the first body wall.

17. The dispenser drawer of claim 12, the pod compartment further comprising:

a plurality of spines protruding from the first body wall along the transverse direction into the pod compartment, the plurality of spines being spaced apart along the lateral direction and extending along the vertical direction.

18. The dispenser drawer of claim 12 the pod compartment further comprising:

a plurality of ribs protruding from the second inner partition portion along the transverse direction into the pod compartment, the plurality of ribs being spaced apart along the lateral direction and extending along the vertical direction from the base plate to a top of the pod compartment.

19. The dispenser drawer of claim 18, the pod compartment further comprising:

a shower plate provided over the pod compartment along the vertical direction, the shower plate comprising a plurality of apertures defined along the vertical direction to allow a flow of water therethrough into the pod compartment.

20. The dispenser drawer of claim 19, wherein at least some of the plurality of apertures are formed at a rear of the shower plate vertically adjacent to the plurality of ribs.

* * * * *